US005214825A

United States Patent [19]

Hirzel

[11] Patent Number: 5,214,825

[45] Date of Patent: * Jun. 1, 1993

[54] PAPER CLIP WITH MULTIPLE PANELS

[76] Inventor: Suzy C. Hirzel, 933 Shellwood Way, Sacramento, Calif. 95831

[ * ] Notice: The portion of the term of this patent subsequent to Apr. 30, 2008 has been disclaimed.

[21] Appl. No.: 689,130

[22] Filed: Apr. 22, 1991

Related U.S. Application Data

[63] Continuation-in-part of Ser. No. 457,948, Dec. 27, 1989, Pat. No. 5,010,629.

[51] Int. Cl.[5] ..... B42F 1/02

[52] U.S. Cl. ..... 24/67.9; 24/67 R; 24/547

[58] Field of Search ..... 24/67.9, 67 R, 67.3, 24/545, 546, 549, 3 J, 67.11, 547, DIG. 8; D19/65

[56] References Cited

U.S. PATENT DOCUMENTS

| | | | |
|---|---|---|---|
| 1,809,689 | 6/1931 | Graves | 24/549 |
| 1,972,434 | 9/1934 | Yerk | 24/3 J |
| 2,184,569 | 12/1939 | Stewart | 24/67.9 |
| 2,478,376 | 8/1949 | De Swart | 24/67.9 |
| 2,768,416 | 10/1956 | McMullen | 24/547 |
| 2,910,749 | 11/1959 | Parker | 24/67.9 |
| 2,938,252 | 5/1960 | Scheemaeker | 24/547 |
| 3,168,954 | 2/1965 | Von Herrmann | 24/67 R |
| 3,673,641 | 7/1972 | Lorber | 24/67.9 |
| 3,914,824 | 10/1975 | Purdy | 24/67.9 |
| 4,286,358 | 9/1981 | Levin | 24/67.9 |
| 4,332,060 | 6/1982 | Sato | 24/67.9 |

FOREIGN PATENT DOCUMENTS

| | | | |
|---|---|---|---|
| 0568514 | 6/1958 | Belgium | 24/67.9 |
| 0978127 | 4/1951 | France | 24/67.9 |
| 1489764 | 6/1967 | France | 24/67.9 |
| 0281894 | 12/1927 | United Kingdom | 24/67.9 |

*Primary Examiner*—Victor N. Sakran

[57] ABSTRACT

An Improved Clip with multiple panels that enables user to secure multiple groupings of gathered papers or the like without wrinkling or cramping. Also, this clip is able to accommodate thin or thick insertions or both simultaneously. The clip having a vertically raised neck(s) and having centrally located stopping elements to prevent the clip from wandering. The outermost panel is larger than the middle panel and the middle panel is larger than the center panel. The front of the center and middle panels are slanted toward the front. The clip also has a rear solid portion having a back edge adapted to be pushed down by fingers. The clip will allow insertion of a single of paper or a stack of papers. The clip is made of one piece by plastic by injection molding and stamped metal sheet, or single wire.

9 Claims, 5 Drawing Sheets

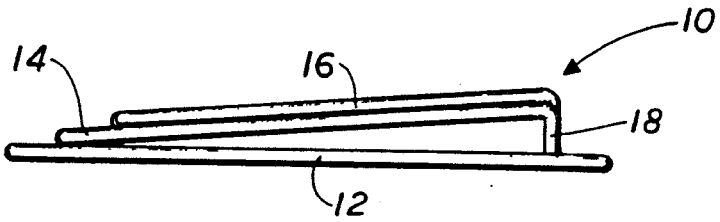
FIG. 4
FIG. 5
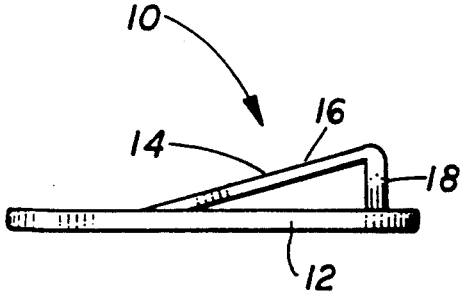
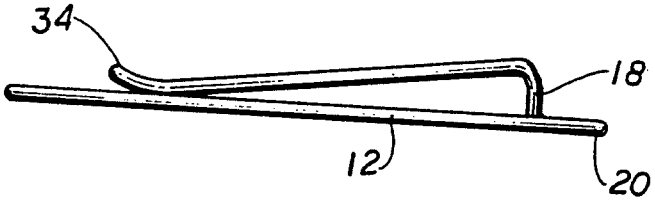
FIG. 6
FIG. 7
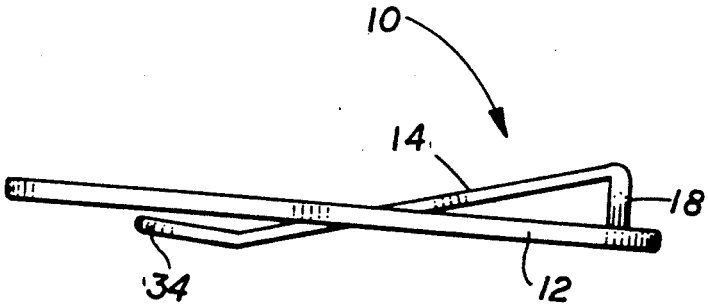

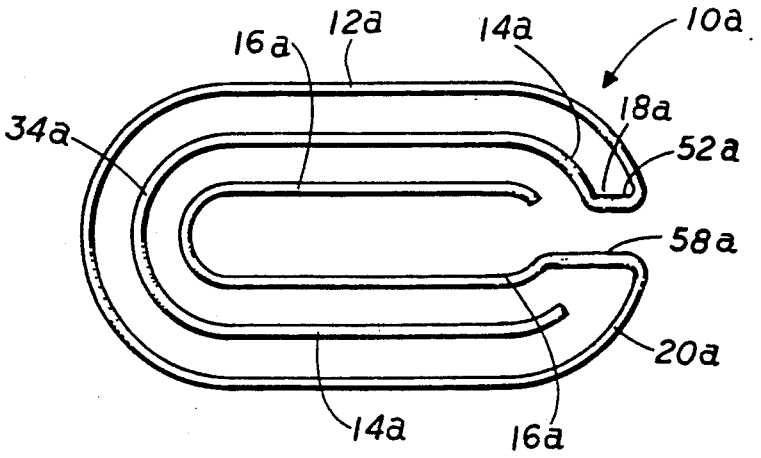
FIG. 11
FIG. 12
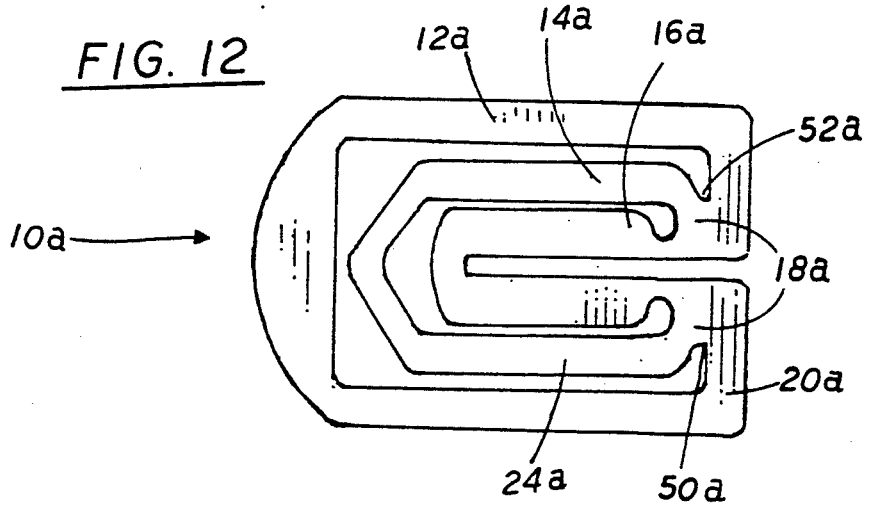
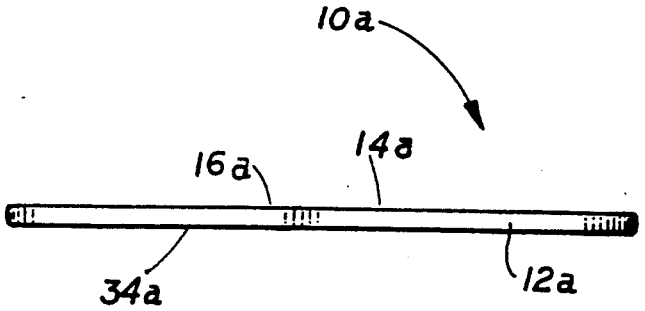
FIG. 13

PAPER CLIP WITH MULTIPLE PANELS

RELATED APPLICATION

The present application is continuation-in-part of U.S. patent application Ser. No. 457,948 filed Dec. 27, 1989 and entitled "IMPROVED PAPER CLIP WITH VERTICAL PANEL". Now U.S. Pat. No. 5,010,629.

FIELD OF THE INVENTION

This invention relates to clips, and more particularly to holding thick or thin gathered papers or other similar materials without wrinkling. Also a single clip is able to separately hold two or more insertions simultaneously.

BACKGROUND OF THE INVENTION

During recent years, the use of paper clips has become increasingly more popular. Plastic clips which have pointed, rounded front shape with the large, smooth edges are well received. However, it can only hold very limited thickness of the gathered papers. U.S. Pat. No. 4,332,060, Hisao, Sato invented clips with spring action having vertical panel, which will hold up to half inch or more. The problems with these clips are, that they are very expensively made, having two or more parts. These types of clips usually have separate handles or springs. These clips are not only expensive, but also bulky in the envelope, and requires a lot of strength to open.

When people send correspondence or document by mail, usually they enclose a check, memo, or business card with the letter. Existing clips do not have additional panel(s) to hold the above mentioned check, memo, or business card. Currently, attachments are stapled or clipped together with additional clips. This is not only time consuming, but also expensive.

J. F. McMullen invented a paper clip for retaining one or more separate insertions. However, his invention, after paper is inserted, nothing prevents the clip from shifting around, which will cause the paper to slide out or move. Because there is only one stopping element and it is located on one side of the clip in the corner, the opposite side wide open. Also, McMullens' invention is confusing, because it does not have definite front or back by glance.

SUMMARY OF THE INVENTION

It is the general objective of the present invention to provide an improved paper clip that will hold one or more insertions. Also, this clip is intended to hold as little as a single sheet or as much as ¾" of gathered paper or other materials, such as checkbooks, pamphlets, or fabric materials (i.e., scarf, handkerchief, or cards, etc.).

Another objective is to make the present invention inexpensive to purchase and inexpensive when being shipped in an envelope. Also, the configuration of the clip is constructed to prevent the user from being scratched handling the clip. However, the top surface of the panels may be textured to prevent inserted items from slipping.

A further objective of the present clip invention is to utilize the centrally located stabilizing member as a stopping element. This stabilizing member/stopping element will prevent the clip from wandering on the clipped material.

Further more clips should have definite looks of front (openings) and back (stopping area), so user can handle the clip fast and efficenintly.

The clip is made of plastic, wire, or stamped metal sheets into a single unit.

The further features of the present invention are set forth in the following detailed description and accompanying drawings.

BRIEF DESCRIPTION OF THE DRAWINGS

FIG. 4 is a side view of the first preferred embodiment of the improved clip with the center panel raised slightly above the plane of the middle panel.

FIG. 5 is a side view of the first preferred embodiment of the improved clip with the tip of the middle panel even with the plane of the outermost panel.

FIG. 6 is a side view of the first preferred embodiment of the improved clip with the tip of the middle panel slightly curved upward.

FIG. 7 is a side view of the first preferred embodiment of the improved clip with the tip of the middle panel slightly below the plane of the outermost panel.

FIG. 11 is a top view of the second preferred embodiment of the improved clip constructed of wire.

FIG. 12 is a top view of the second preferred embodiment of the improved clip with two necks.

FIG. 13 is a side view of the second preferred embodiment of the improved clip.

DETAILED DESCRIPTION

Figure 1:
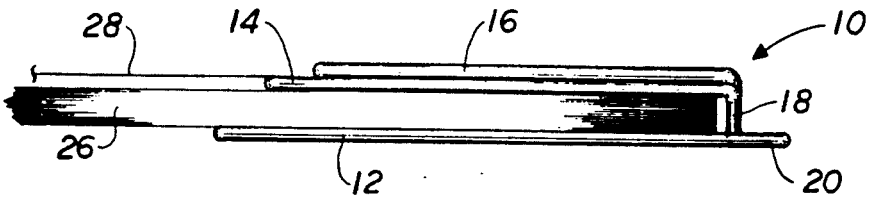
FIG. 1 is a side view of the first preferred embodiment of the improved clip showing with thick gathered paper.

FIGS. 1, 2, 3, 4, 5, 6, 7, 8, 9 and 10

Referring more particularly to FIGS. 1, 2, 3, 4, 5, 6, 7, 8, 9 and 10. The first embodiment of the improved paper clip with multiple panels is schematically depicted therein, thus, 10 is shown.

Clip 10 is comprised of an outermost panel 12, middle panel 14, and center panel 16 (FIGS. 1–10).

Outermost panel 12 has a back portion 20.

Middle panel 14 has back portion 30.

Center panel 16 has back portion 40.

Neck 18 is the extension of back portion 30.

Neck 58 is the extension of back portion 40.

The point at which back portion 20 meets neck 18 creates stopping element 50 and 52.

Figure 8:
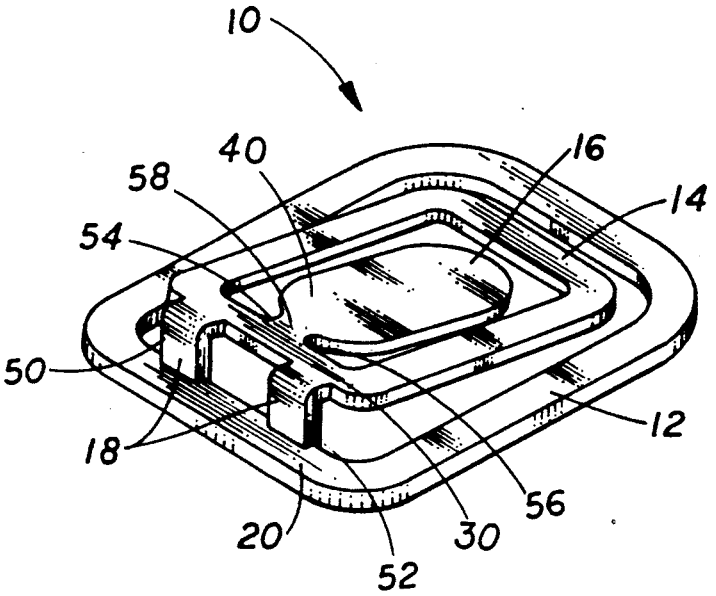
FIG. 8 is a perspective view of the first preferred embodiment of the improved clip with two raised necks.
Figure 9:
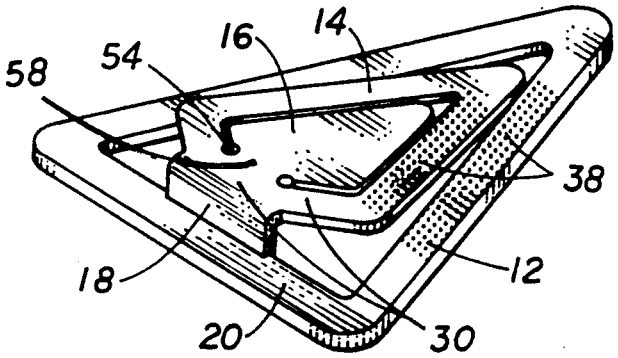
FIG. 9 is a perspective view of the first preferred embodiment of the improved clip with one raised neck.

The point at which back portion 30 meets neck 58 creates stopping elements 54 and 56. (FIGS. 8 and 9)

Figure 10:
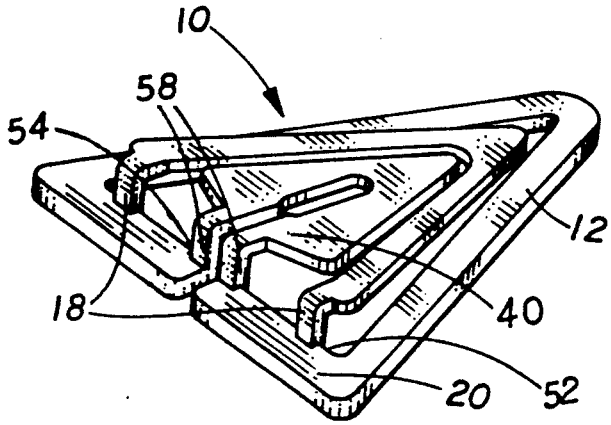
FIG. 10 is a perspective view of the first preferred embodiment of the improved clip with four raised necks.
Figure 14:
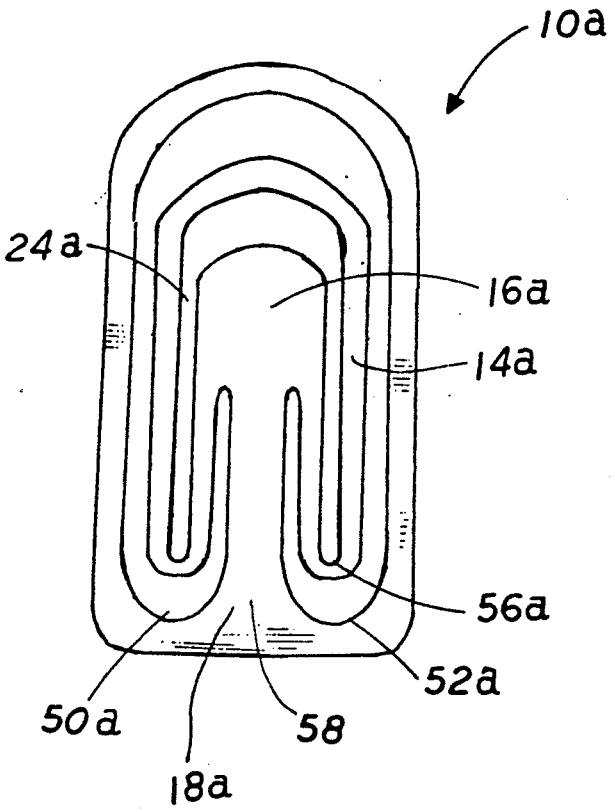
FIG. 14 is a top view of the second preferred embodiment of the improved clip with one neck.

However, FIG. 10 is an exception, necks 58 are connected directly to back portion 20. This method is to make the center panel 16 extra flexible, so thicker materials can be inserted between the space 24.

The distance between stopping element 50 and 52 should be sufficiently wide enough to stabilize and prevent the clip from wandering.

The neck 18 is raised vertically (FIGS. 1–10). This will produce a generally hollow triangular shaped space (FIGS. 4–7) when viewed from the side of the clip. The height of the neck 18 can range from 0 to 1¼". The greater neck height will allow thicker insertion. Neck 58 may also be raised to allow for thicker insertion (FIGS. 1 and 4).

Back portion 20 is useful when pushed down by finger(s) to steady the clip while panels are opened for loading of insertions.

Panels 14 and 16 are slanted toward front of clip 10. Front tip 34 of the middle panel 14 may be slightly above (FIGS. 4 and 6), or flush (FIG. 5), or below the plane of panel 12 (FIG. 7). Also front tip 34 may be tipped upwardly (FIGS. 6 and 7) for easy gripping. Tip 34 being below the plane of panel 12, exerts greater pressure on the inserted materials which is critical when an object which may be thinner than neck height.

Figure 2:
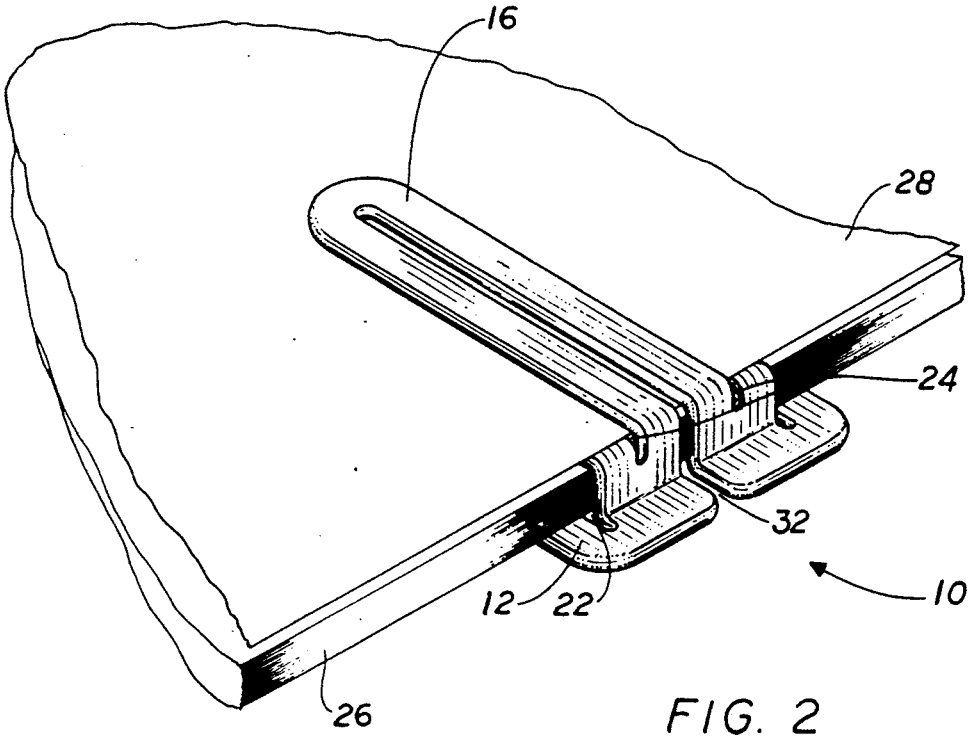
FIG. 2 is a perspective side-top view of the first preferred embodiment of the improved clip showing the gathered papers and an additional paper on the top.
Figure 3:
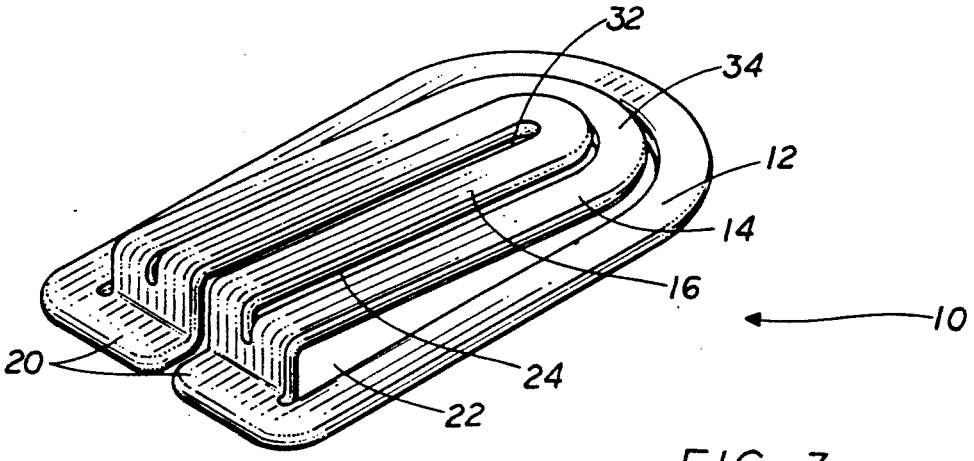
FIG. 3 is a perspective side-top view of the first preferred embodiment of the improved clip.

Space 24 is between panel 14 and panel 16. Space 22 is between panel 12 and panel 14 (FIGS. 1 and 3). Thick materials 26 can be inserted into space 22, and a thinner materials 28 can be inserted into space 24 (FIGS. 1 and 2).

Often, when documents are sent, a letter may be enclosed. Double insertions of the present invention will allow the separate, but simultaneous attachment of a letter on top of the other included insertion. Also, this clip will be useful when holding together pages in books, closing files to be stored in file cabinets, or as a money clip.

The outermost panel 12 width and length may range from ¾" to 5", assuming the length will always be longer than the width. Panel 14 being smaller than panel 12 and panel 16 being smaller than panel 14 will vary in length and width accordingly. Also, center panel 16 is preferred to be thinner than panel 14 (FIG. 9). This method will eliminate the wrinkling effect when thin paper is inserted space 24, while reducing the overall weight and cost of materials to produce.

The space 24 may be extended to neck 18. This method will allow the material to be fully inserted to the neck area (FIGS. 2, 3 and 10). However, in specific configurations, space 24 may end before reaching the neck 18 area (FIGS. 8 and 9).

Split 32 is located in the center of panel 16 (FIGS. 2 and 3). Split 32 is functional when inserting materials thicker than the actual neck height because this allows the clip to be even more flexible and accommodating as well as lighter in weight due to incorporation of less material. However, the surface of panel 16 may be specifically configured without the center split 32 to allow for printing, decorating, or writing on the surface (FIGS. 8 and 9). Panel 16 front is usually rounded or pointed for easy insertion.

Additional panels can be created by incorporating additional space in the center panel 16 or extend the back portion 20 and add another panel beyond the outermost 12 (not shown). However, applicant considers three panels to be enough.

Exterior of the upper panels 14 and 16 may have textured surface 38 (FIG. 9) for preventing papers from sliding. The textured surface 38 can be raised dots, sand-paper texture, or any type of grooves which have uneven textures.

The reason for the textured upper surface of the middle and outermost panels is to prevent the printed matter on the inserted documents from being damaged when inserting or removing materials. Usually paper clip users will insert their documents with the written surface facing up. This method will prevent the course surface from coming in contact with the written surface. However, textured surface can be located anywhere on entire clip.

FIGS. 11, 12, 13 and 14

A second preferred embodiment of the improved clip with multiple panels are shown in FIGS. 11, 12, 13, and 14. Clip **10*a* is similar to 10** and bear the same numerals, and are succeeded by the letter "a".

Clip **10*a* is identical to Clip 10 but without neck 18*a*** being raised.

Outermost panel **12*a*, middle panel 14*a*, and center panel 16*a* are all in same plane (FIG. 13**).

Clip **10*a* can be made of plastic or metal, while FIG. 11** can ideally be made of one continuous solid wire.

The thickness of the clip depends on the material. If metal sheet is used, it can be stamped or die cut, which will allow it to be thinner than plastic embodiment. Spring metal would be the ideal material for manufacturing metal clip, because it will always return to its original form. If plastic is used, it can be injection molded in various colors to identify and organize the sizes, etc.

Various modifications, changes, alterations, and additions can be made in the improved Clip with multiple panels of the present invention, its components, and their parameters. All such modifications, changes, alterations, and additions as are within the scope of the appended Claims form part of the present invention.

Accordingly, the improved Clip with multiple panels is efficient, inexpensive, and durable. It is of novel configuration and utility.

What is claimed is:

1. An Improved Clip with multiple panels comprised of:

clip having at least three horizontal panels, first, second, and third, having front, side, and back portions respectively, said clip having at least two horizontal spaces, first and second, having front and side, said first space is in between said first panel and second panel, said second space is between the second panel and said third panel, said second space is larger than said first space, said third panel is larger than said second panel, and said second panel is larger than said first panel, said second panel is within the perimeter of said third panel and said first panel is within perimeter of said second panel, said clip having first and second neck, said necks are comprised of front-end and back-end, said front end of the said first neck is connected to said back portion of the first panel, said front-end of the second neck is connected to the back portion of the second panel, said clip having at least two stopping elements, said stopping elements are located where said back portion(s) joins said neck(s) of said back-end, said clip is made of one piece rigid material, said clip is longer in length from front to back than from side to side, said second and third panels having textured surfaces, said first panel is thinner than said third panel, such dimension will eliminate the wrinkling effect when thin paper is inserted in said first opening, while reducing the overall weight and cost of materials to produce said clip.

2. The Improved Clip with multiple panels of the claim 1 wherein said second neck is raised vertically.

3. The Improved Clip with multiple panels of the claim 2 wherein said first neck is raised vertically.

4. The Improved Clip with multiple panels of the claim 2 wherein said raised neck creates a generally triangular-shaped space when seen from the side view.

5. The Improved Clip with multiple panels of the claim 1 wherein said space between second and third panels accommodate thicker insertions than between first and second panels.

6. The Improved Clip with multiple panels of the claim 1 wherein said front of said second panel is lower than the plane of said third panel.

7. The Improved Clip with multiple panels of the claim 1 wherein said front of said second panel is curved upward for easy lifting of said second panel.

8. The Improved Clip with multiple panels of the claim 1 wherein said clip is made of one piece with plastic and injection molded.

9. The Improved Clip with multiple panels of the claim 1 wherein said clip is made of spring metal.

* * * * *